US006923177B2

(12) United States Patent
Hart

(10) Patent No.: US 6,923,177 B2
(45) Date of Patent: Aug. 2, 2005

(54) UNDERWATER BREATHING DEVICE

(76) Inventor: Robert Patrick Hart, 90 School Lane, Broomfield, Chelmsford, Essex (GB), CM1 7DS ( * ) Notice: Subject to any disclaimer, the term of this patent is extended or adjusted under 35 U.S.C. 154(b) by 50 days.

(21) Appl. No.: 10/333,486

(22) PCT Filed: Feb. 16, 2001

(86) PCT No.: PCT/GB01/00625

§ 371 (c)(1),
(2), (4) Date: Jan. 17, 2003

(87) PCT Pub. No.: WO02/06113

PCT Pub. Date: Jan. 24, 2002

(65) Prior Publication Data

US 2003/0168061 A1 Sep. 11, 2003

(51) Int. Cl.[7] ..... B63C 11/02

(52) U.S. Cl. ..... 128/201.27; 128/201.28; 128/202.14

(58) Field of Search ..... 128/201.27, 201.28, 128/202.14; 405/186; 114/315; 441/112, 116; 224/153

(56) References Cited

U.S. PATENT DOCUMENTS 1,059,215 A * 4/1913 Roth ..... 128/201.27
2,483,116 A * 9/1949 Yarbrough ..... 128/202.14
3,820,348 A * 6/1974 Fast ..... 405/186
3,877,098 A * 4/1975 Braly ..... 405/186
4,016,616 A * 4/1977 Walters ..... 405/186
4,137,585 A * 2/1979 Wright, III ..... 405/193
4,324,234 A * 4/1982 Maness ..... 128/202.14
4,561,853 A * 12/1985 Faulconer et al. ..... 441/106
4,645,465 A * 2/1987 Courtney ..... 441/40
4,694,772 A * 9/1987 Faulconer et al. ..... 114/315
4,778,307 A * 10/1988 Faulconer ..... 405/186
4,779,554 A * 10/1988 Courtney ..... 114/315
4,790,463 A * 12/1988 Hansen ..... 224/680
4,946,313 A * 8/1990 Augurelli ..... 405/186
4,952,095 A * 8/1990 Walters ..... 405/186
4,986,700 A * 1/1991 Takeda ..... 405/186
5,011,334 A * 4/1991 Vorhauer ..... 405/186
5,101,818 A * 4/1992 Chace et al. ..... 128/202.14
5,346,419 A * 9/1994 Kaiser ..... 441/96
5,370,113 A * 12/1994 Parsons ..... 128/205.22
5,403,123 A * 4/1995 Walters ..... 405/186
5,887,585 A * 3/1999 Dusenbery ..... 128/202.14

* cited by examiner

*Primary Examiner*—Aaron J. Lewis
(74) *Attorney, Agent, or Firm*—Renner, Kenner, Greive, Bobak, Taylor & Weber

(57) ABSTRACT

A versatile underwater breathing device which comprises, a pressurized gas reservoir or tank (21), a buoyancy bladder (72), bladder inflation control means (76), a breathing regulator (32) in communication with the gas reservoir; and a flexible adaptable carrier having straps (88, 90) for securely attaching the carrier to the back of a diver, which carrier wholly contains the buoyancy bladder and the gas reservoir. The bladder inflation control means operatively couple the buoyancy bladder to the reservoir so that the bladder may be inflated and deflated to control the buoyancy of a diver, and the breathing regulator is also coupled to the gas reservoir to permit the breathing of the contained gas by the diver. The flexible carrier is adapted to be carried on the back of a wide range of differently sized divers so allowing a single piece of equipment to be used by a variety of people.

16 Claims, 6 Drawing Sheets

UNDERWATER BREATHING DEVICE

The present invention relates to underwater breathing devices.

Standard scuba (self-contained under water breathing apparatus) equipment essentially comprises a buoyancy control jacket that must fit snugly around the torso of a person diving and contains air pockets to regulate the buoyancy of the diver whilst diving; an air tank in the form of a pressurised gas cylinder (or cylinders) attached to the rear of the buoyancy control jacket; a regulator so that the diver may breathe from the tank; and an inflation mechanism linking the interior insides of the buoyancy control jacket to the tank so that the degree of inflation of the jacket may be altered. In addition to this, the diver will also require a mask and weights.

Whilst this equipment is acceptable for experienced adult divers, it has major limitations for those who are smaller in size, those who are put off by the unwieldy nature of the equipment, and those needing equipment that is simpler and easier to use and maintain.

It is essential, for practical and safety reasons, when using standard scuba equipment that the buoyancy control jacket fits securely to the diver, but unfortunately very little effort has been made to design buoyancy control jackets that are suitable for more than a narrow range of adult sizes. The major reason for this is that whilst in theory one could simply scale down a buoyancy control jacket to fit a child or small adult, such a reduced sized buoyancy jacket does not provide sufficient lift to counteract the weight of a tank and so tends not to function effectively, if at all. What is more, as children by nature vary in size, one fitting of buoyancy control jacket would have limited use for any single child due to it being rapidly out-grown. This tends to make the sport of diving prohibitively expensive, especially for children.

In order to increase the already substantial popularity of scuba diving as a leisure activity, the major training agencies such as PADI (Professional Association of Diving Instructors) are keen to encourage new people to become involved. In addition, the lower age limit for learning to dive has recently been reduced from 12 to 8 years in order to encourage participation from an earlier age. These factors together have enhanced an already large demand for first time divers to have a short so-called "try dive". However, the weight and unwieldy nature, not to mention the lack of suitable sizes of the existing scuba equipment, means that it is highly undesirable for this kind of application.

In addition to the disadvantages discussed above, conventional scuba equipment is expensive to purchase and then expensive to maintain. The buoyancy control jacket, which is the essential frame work upon which the tank and breathing regulator are mounted, is complex and therefore costly to produce and repair. This further adds to the difficulties associated with encouraging new divers as the necessity to purchase and maintain such expensive equipment (whether by individuals or training organisations) drives up the cost of offering such "try dives" thereby making them far less desirable for yet another reason.

It is an aim of the present invention to overcome the inadequacies of conventional scuba equipment and encourage new or inexperienced divers, especially children, to take up the sport. An alternative but complementary aim of the present invention is to eliminate the use of conventional buoyancy control jackets and provide a self-contained underwater breathing apparatus which is cheap to produce, is of a modular design to allow convenient replacement of individual parts, and is securely and comfortably attachable to the torso of a wide range of differently sized divers.

Therefore, according to the present invention there is provided an underwater breathing device comprising a pressurised gas reservoir, a buoyancy bladder, bladder control means operatively coupling the buoyancy bladder to the reservoir so that the bladder may be inflated and deflated, a breathing regulator in communication with the gas reservoir to permit breathing of contained gas by a diver, and a flexible adaptable carrier having straps for securely attaching the carrier to the back of a diver, which carrier wholly contains the buoyancy bladder and the gas reservoir, when the device is in use.

For convenience the carrier will be a closable bag that will contain the appropriate components, and the reservoir may be in the form of a cylinder. The components within the bag may be attached to each other and/or to the bag, but as the material may be a flexible material this may be less than ideal. In order to provide a reliable structure, as well as defining a comfortable shape for the back-worn device, a rigid or relatively-rigid baseboard may be connected to the carrier in the region that in use is disposed adjacent the diver's back. The gas reservoir and buoyancy bladder may be attached to the baseboard. Preferably the gas reservoir, being the heaviest component, is located on a lower part of the device, and the bladder is attached nearer the top. In this way, the device will tend to ensure the diver floats in the desired orientation with their head higher than their feet.

To permit replacement, repair or recharging the gas reservoir and buoyancy bladder are independently removable. The other parts such as the regulator, pipes, inflator/deflator means, and the depth gauge may also be replaced, as appropriate.

As the buoyancy bladder is inflated and deflated, its volume will of course change. The buoyancy bladder is usually contained within a bag so the bag must be able to accommodate such volume fluctuation. This may be achieved by forming the bag from an elasticated material which will stretch when the buoyancy bladder inflates and will contract when it deflates again. In this way the bag will always stay as compact and neat as possible. Alternatively the bag may be substantially formed from an un-elasticated material with elasticated straps or strands provided at appropriate points to achieve the same effect.

It is highly preferred that access may easily be gained to the inside of the bag, therefore the bag may be provided with a re-closable opening flap. This may be a flap on a side of the carrier not disposed against the diver's back so permitting access to the interior even when the device is being worn.

It is essential that the buoyancy bladder is operatively linked to the gas reservoir, and the bladder control means may be any existing manually operable inflator/deflator valve.

When under water, deflation of the buoyancy bladder is, at least partially, caused by water pressure forcing the air out through the deflator valve when it is opened as required. To aid this process, especially when on the surface (where no natural compression of the bag occurs) an elasticated restriction band may be provided around the buoyancy bladder. This may be in the form of an elasticated strap affixed to the baseboard, or may be one or more continuous elasticated bands disposed around the bladder.

When diving it is important that a certain degree of negative buoyancy can be achieved so that a diver may descend. The buoyancy bladder may then be used to control the buoyancy of the diver by setting the degree of positive buoyancy that is provided to counter this overall negative state. For example when un-inflated the negative buoyancy takes the diver down, and then by careful inflation of the bladder a neutral then positive buoyancy may be established. Weight may be provided by a conventional weight belt, but as one of the main aims of this device is to simplify diving, having a requirement for such additional equipment is undesirable (although necessary if the diver is particularly buoyant). Therefore, the bag may be provided with a pouch or pouches to receive removable weights preferably in the form of bags of lead shot. In this way weights may be held within the bag, rather than encumbering the waist.

In is essential that a device according to the present invention is comfortable to wear. Therefore, padding may be provided on the side of the device disposed toward the diver's back. This will cushion the diver's back from the contents of the carrier or from the baseboard which is relatively rigid.

To further enhance comfort, the straps around the diver must not be unpleasant to wear. In practice, suitably designed straps may be fixed to either the carrier or the baseboard. However, to improve comfort for a range of differently sized users (utilising the same device) each strap may instead pass through a first entry aperture in the carrier and subsequently pass out through a second exit aperture, also in the carrier. The free ends of this otherwise continuous strap may be passed around the diver and then be releasably connected together. The device may have only shoulder straps, or indeed only a waist strap, but in almost all situations both a waist strap and two shoulder straps would be provided, as this offers the most stable attachment.

The waist and shoulder straps may be provided with standard connectors and length adjusting means. In addition the carrier may be provided with various anchor points to which the straps may be attached. In this way the straps may be positioned for optimum comfort on differently sized divers. For example the upper end of the shoulder straps could be permanently anchored on the carrier, and lower ends selectively connectable to a range of anchor points dependant on the size of the diver.

As the device is worn on the back of a diver, the regulator and bladder control means must pass out of the bag, so that a diver may breathe and control the inflation of the buoyancy bladder whilst wearing the device on his/her back like a rucksack. A single hose may extend from the reservoir to a point near the top of the bag and connect to a hose splitter which allows the connection of at least two other hoses. These hoses may then connect to the regulator and bladder control means. A gas reservoir pressure gauge may also be provided to assess the remaining supply of gas.

In order further to reduce the intrinsic weight of the device, in an alternative embodiment the conventional tubular gas cylinder may be replaced by a one that is toroidal in shape. Such a toroidal reservoir is able to hold gas at a greater pressure so more gas can be fitted in the same volume. This will enhance the capabilities of the present invention as conventional cylinders capable of fitting in a device according to the present invention cannot hold a large supply of gas. If a greater volume of gas could be compressed into a cylinder of comparable weight and dimensions, then longer dives could take place using the present invention.

By way of example only, various specific embodiments of the present invention will now be described with reference to the accompanying drawings in which.

Figure 1:
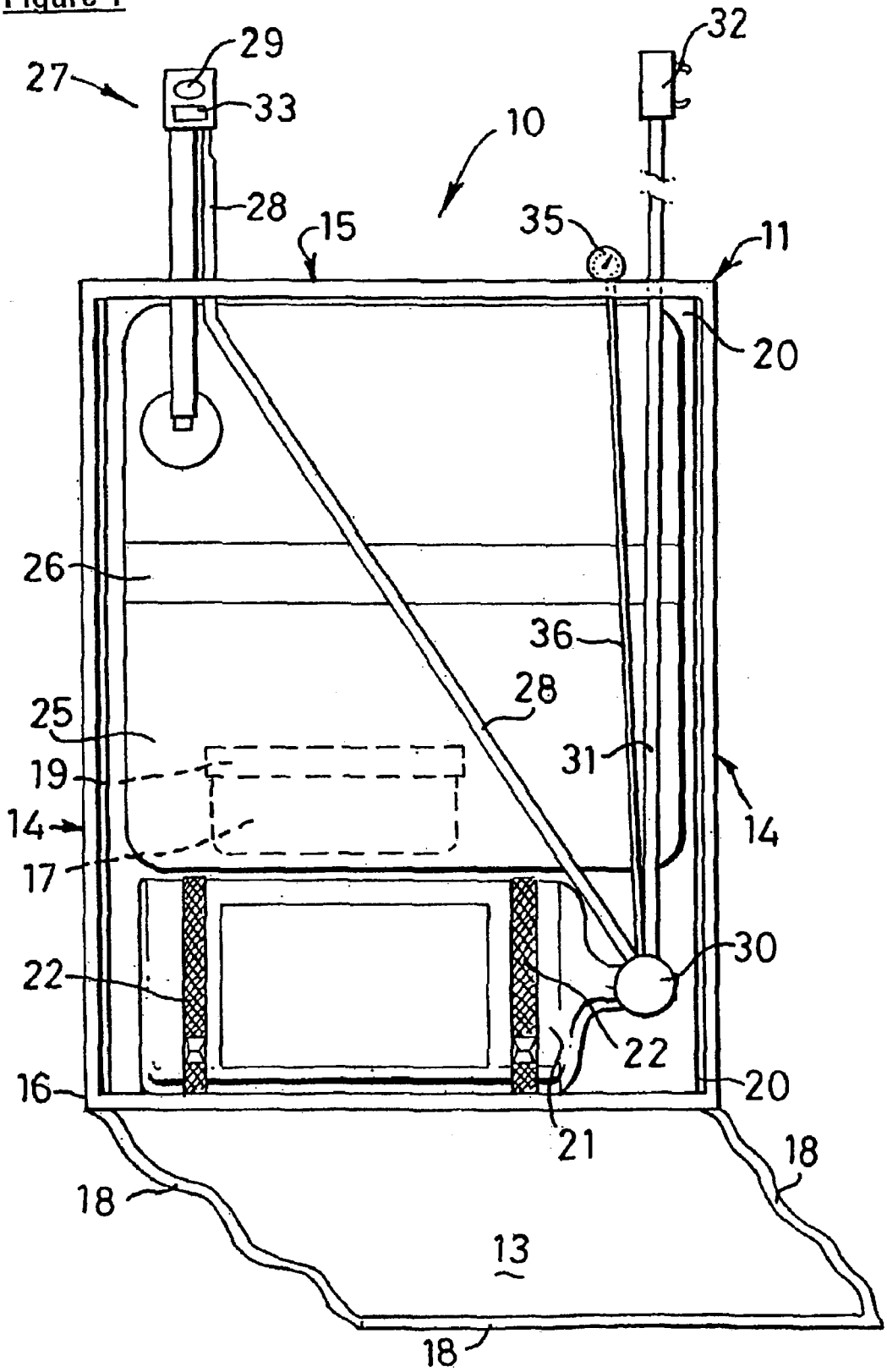
FIG. 1 is a diagrammatic rear view of a first embodiment of the present invention.
Figure 2:
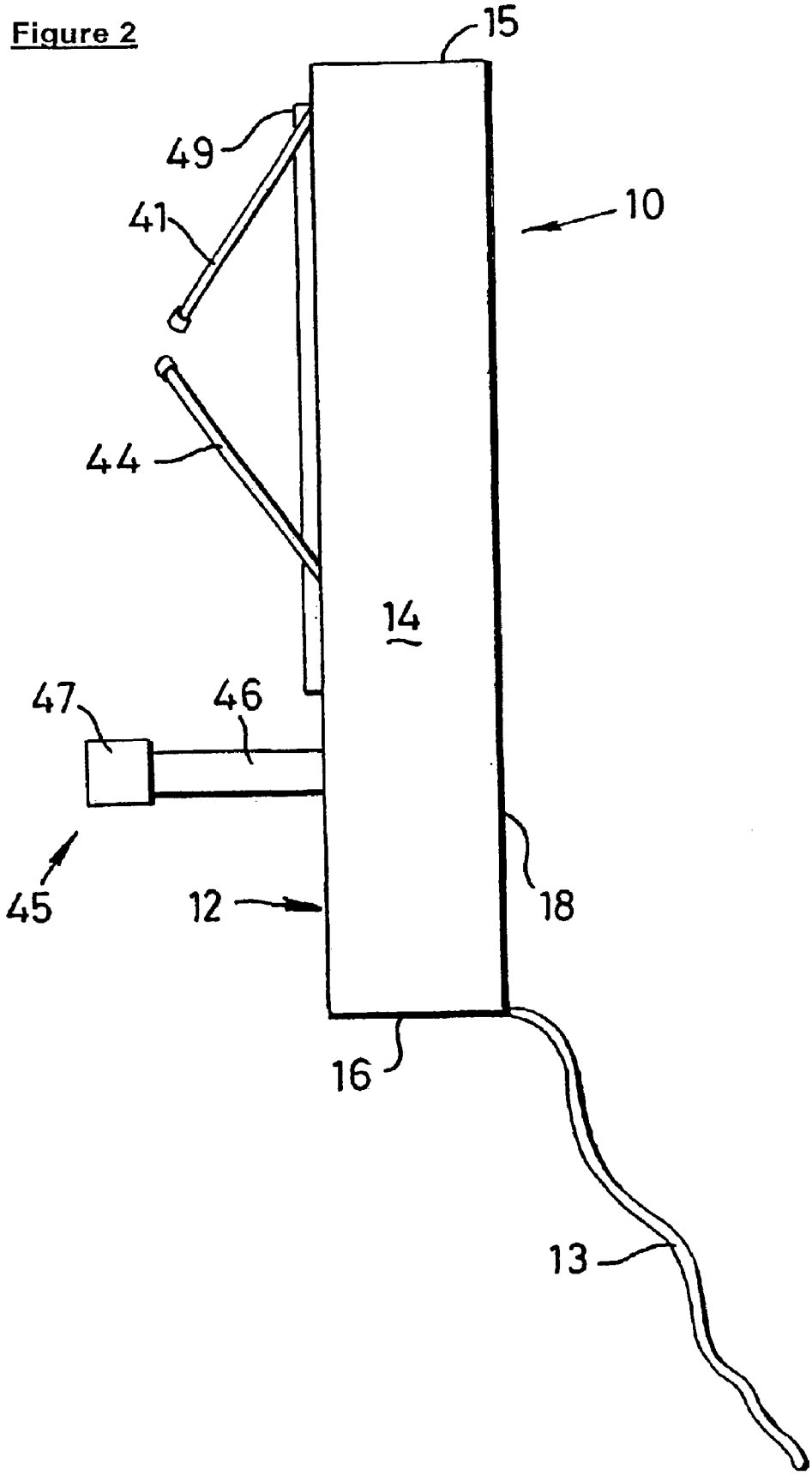
FIG. 2 is a diagrammatic side view of the embodiment of FIG. 1.
Figure 3:
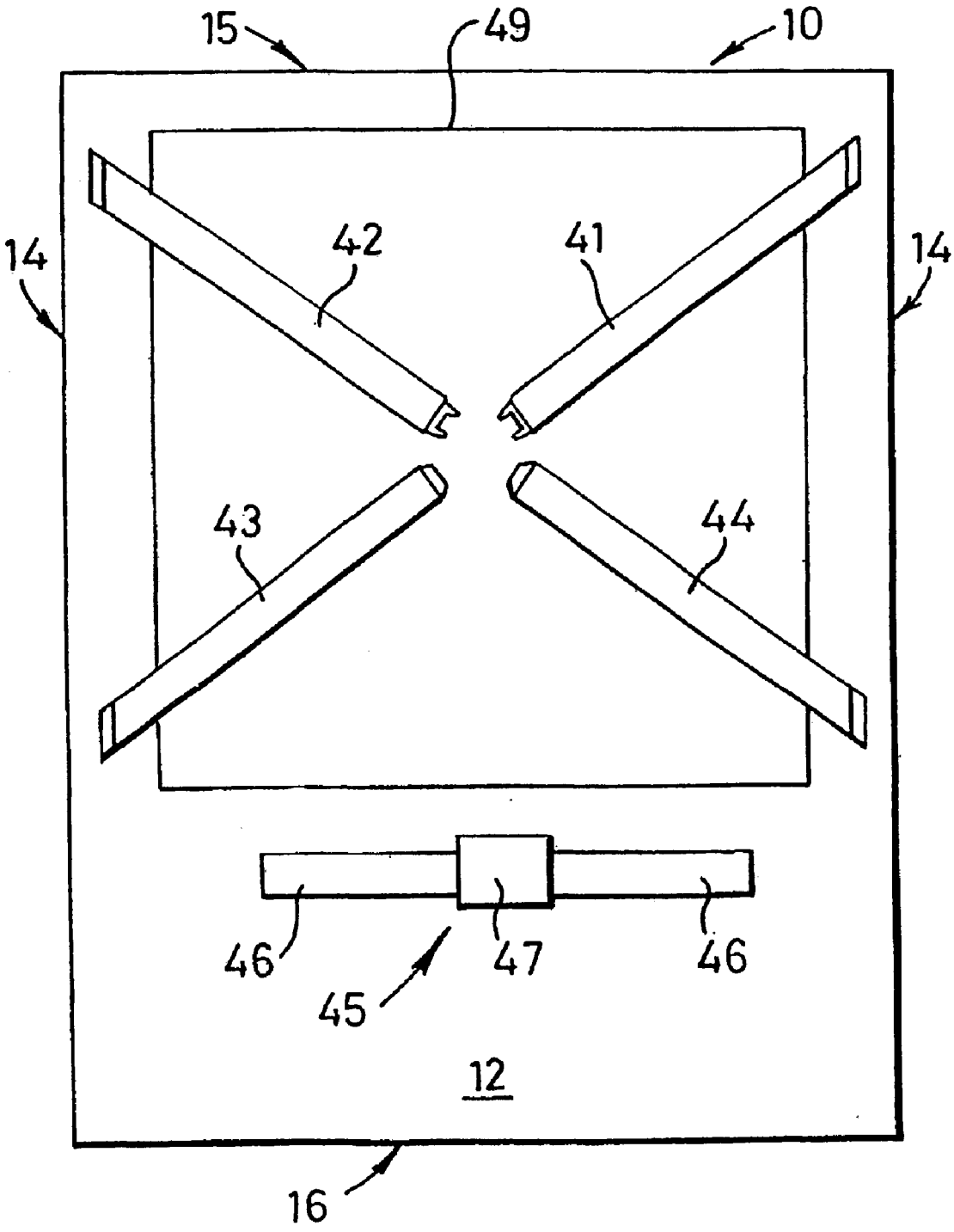
FIG. 3 is a diagrammatic front view of the same embodiment shown in FIGS. 1 and 2.

Referring simultaneously to FIGS. 1, 2 and 3, an underwater breathing device generally indicated 10 is shown. The device 10 comprises a bag 11, shown in an open configuration, within which the majority of the other components are located. In this embodiment, the bag 11 is shown stylistically as being generally cuboid, however, in practice the bag is likely to be formed from flexible material so would have a far less regular shape. What is more, and as will become more apparent, the bag changes shape during use.

The bag 11 is comprised of a front panel 12, rear panel 13, side panels 14, top panel 15 and a bottom panel 16. The rear panel 13 comprises a flap which is permanently connected along one edge to the bottom panel 16 and the remaining three free edges 18 are releasably connectable to the corresponding edges of the top and side panels. The flap covers an opening which gives access to the interior of the bag. The releasable connection may be conveniently achieved using hook and loop fasteners such as Velcro® or elongate clasp fasteners such as those sold under the trade name zip.

A baseboard 20 is contained within the bag 11 and is attached thereto adjacent the front panel 12. A gas cylinder 21 is releasably connected to a lower portion of the baseboard 20 using straps 22.

Also attached to the baseboard 20 and located above the cylinder 21 is a buoyancy bladder 25. An elasticated restriction band 26 is fitted around the bladder to aid its deflation. The buoyancy bladder may be inflated and deflated using the valve arrangement 27 which is linked to the gas cylinder 21 by inflator hose 28. Such inflator/deflator valve arrangements are well known in the art and will not be described in great detail here. However in basic operation, suitable control of the valve 27 will either allow the escape of gas from the interior of the bladder 25 or will permit the inflation of the bladder by the introduction of pressurised gas from the cylinder 21 through the inflator hose 28. Depression of inflate button 29 alters the valve arrangement so that pressurised gas from the hose 28 is channelled into the buoyancy bladder 25. Depression of deflate button 33 allows gas to vent from the interior of the bladder to the outside, but prevents loss of gas from the hose 28.

As can be seen from FIG. 1, a weight pouch 17 is attached behind the buoyancy bladder to the inside of the baseboard 20 so that removable weights may be added. These are usually in the form of bags of lead shot, and the pouch 17 has a closing flap 19 held down by Velcro® to prevent their accidental exit from the pouch 17. The baseboard may be held in place by a strap of material (not shown) attached to the inside of the front panel 12. Such a strap would pass between the baseboard and the buoyancy bladder, and the pouch 17 could be attached thereto.

A first stage regulator 30 is attached to the output of the cylinder 21. This partially reduces the pressure of the gas which is then passed along the intermediate pressure hose 31 to the second stage regulator 32. The intermediate pressure hose 31 passes out of reinforced holes (not shown) in the bag and extends far enough to permit the second stage regulator to be held within the mouth of the wearer and used in a conventional fashion. A pressure gauge 35 is connected via a high pressure hose 36 to give a tank pressure reading. This indicates the remaining air supply within the tank.

As can best be seen from FIGS. 2 and 3, the front panel 12 of the device 10 is provided with a variety of straps for affixing the device to the back of a diver. Shoulder straps 41, 42, 43 and 44 are provided. The straps may be connected either diagonally across the chest with 41 connecting to 43 and 42 connecting 44, or alternatively, the straps may be connected vertically around the upper part of the arms (as in a conventional rucksack) with strap 41 connecting to strap 44 and strap 42 connecting to strap 43. A waist belt 45 is provided at a point below the shoulder straps and is intended to pass around the waist of a diver with the two halves 46 being connectable via fastener 47. To enhance the diver's comfort, a back pad 49 is provided at a point where the device presses against the back of a diver. This comfort enhancing feature could alternatively be contained within the bag 11 between the front panel 12 and the baseboard 20.

The straps 41, 42, 43, 44 and the waist belt 45 may be directly connected to the baseboard 20. Alternatively they may pass through a pair of apertures provided in the front panel 12 and the baseboard. This allows pairs of straps to be formed from a single piece of material and enhances the comfort of the diver. The diver's comfort is enhanced because a degree of movement between the straps and the remainder of the device is permitted thereby allowing the bag and its contents to move and fit in the most comfortable position, even when the diver is moving.

Figure 4:
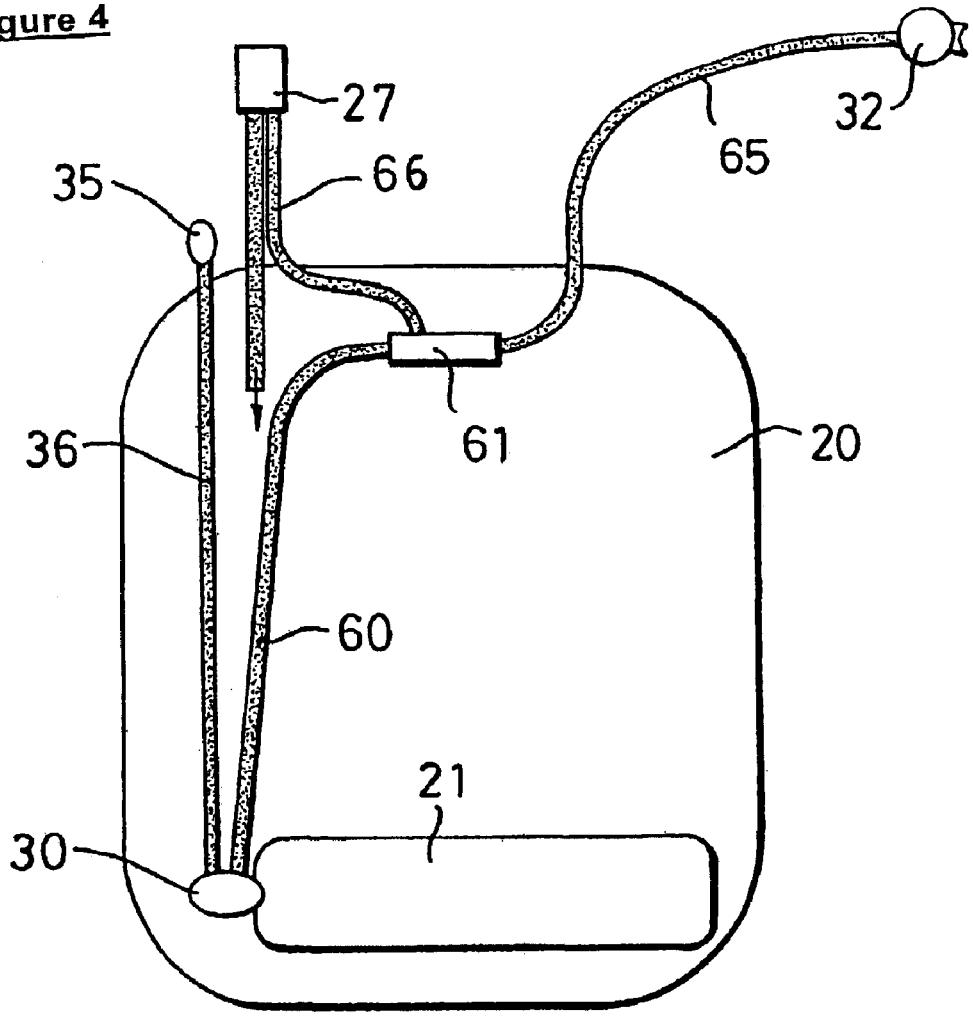
FIG. 4 is a simplified view of an alternative arrangement of parts omitting the bag and buoyancy bladder for clarity, but including a hose splitter.
Figure 5:
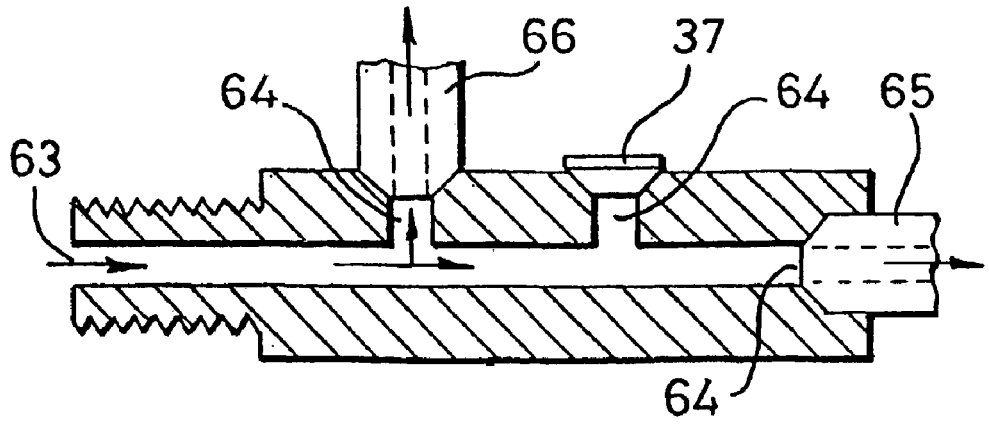
FIG. 5 is a cross-section through the hose splitter in FIG. 4.

A similar embodiment is shown in a simplified form in FIG. 4. In this alternative embodiment, a single intermediate pressure hose 60 is used to connect the first stage regulator 30 to a hose splitter 61 located near the top of the baseboard 20. As can be seen from FIG. 5, the hose splitter has a is screw-threaded inlet port 63 and at least two outlets ports 64. The intermediate pressure hose 60 is connected to the inlet port 63 and a breathing hose 65 running to the second stage regulator 32 is connected to one outlet port 64, and the inflator/deflator valve 27 is connected by a buoyancy hose 66 to another outlet port 64. Any spare ports are closed by blanking caps 67. A spare second stage regulator (not shown) could be attached to the spare outlet port.

Such a hose splitter has several advantages. Firstly, it reduces the bending of hoses that may occur when fitting them into the bag. Such bending can damage the hoses and so reduce their safety and efficiency. Secondly, the movement of the connection point for the second stage regulator and the inflator/deflator valve to the top of the baseboard means that standard length pipes can be used whilst allowing the operative ends to extend further out of the bag. The hose splitter can be formed from a single machined piece of brass or other suitable material.

Figure 6:
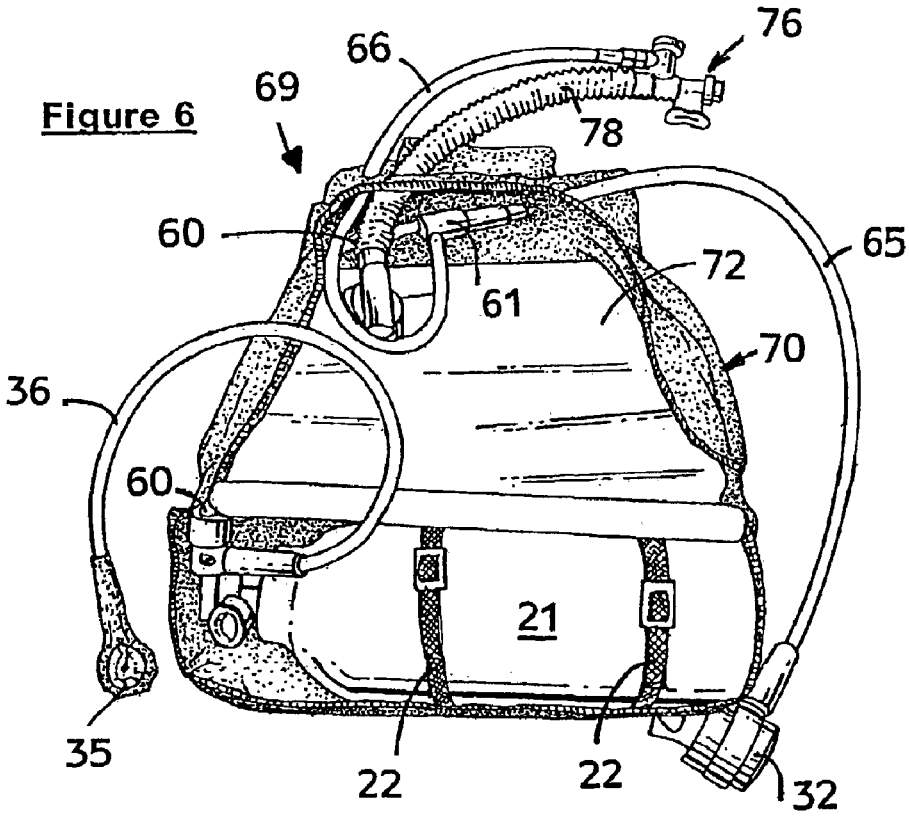
FIG. 6 is a rear view of a third embodiment of the present invention showing the contents of the carrier.
Figure 7:
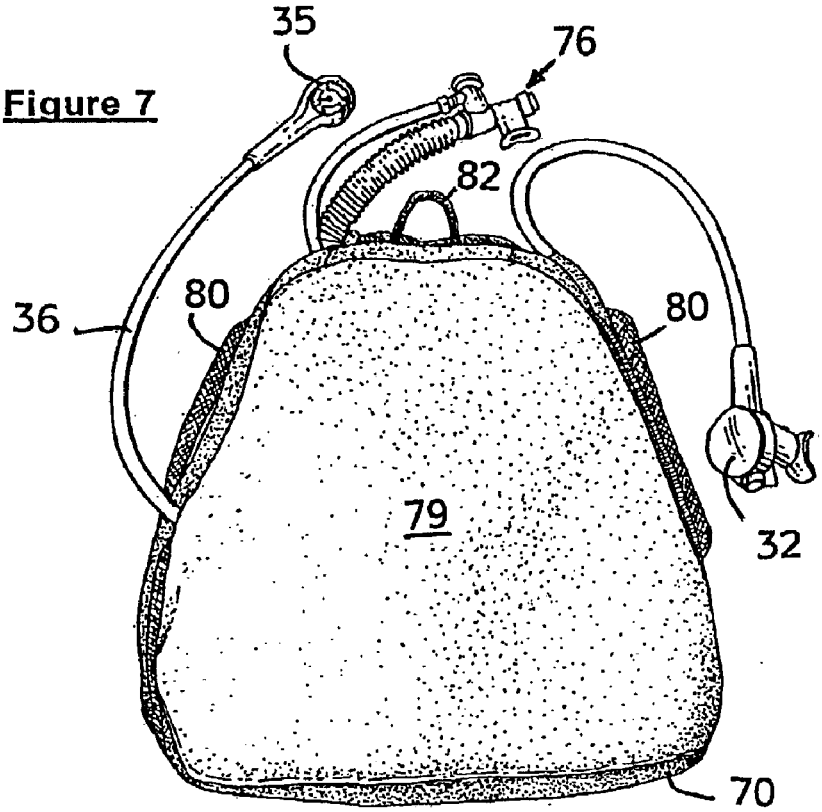
FIG. 7 is a rear view of the third embodiment of the present invention shown in FIG. 6 but with the flap closed to conceal the contents; and, FIG. 8 is a front view of the third embodiment.
Figure 8:
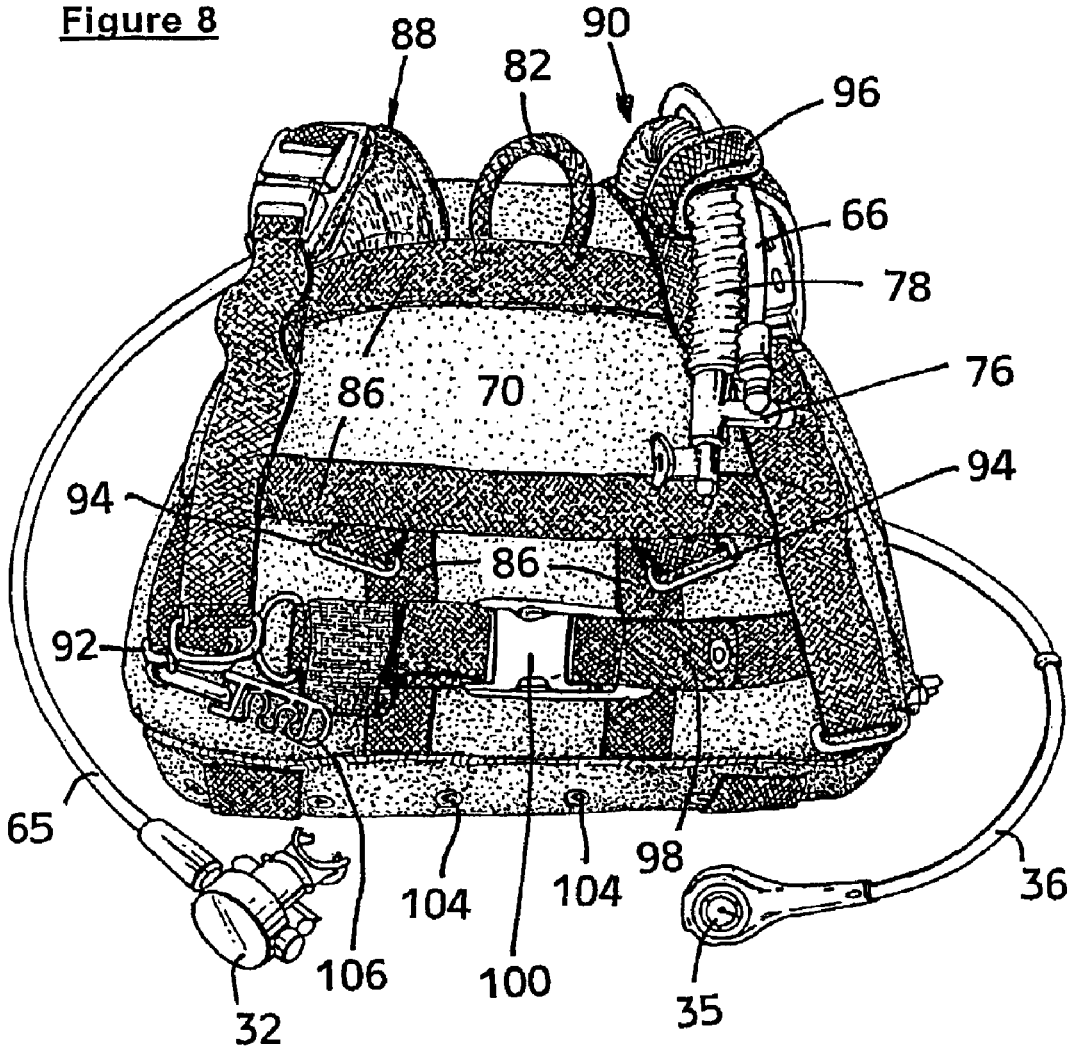

The third embodiment shown in FIGS. 6 to 8 is overall similar to the first embodiment shown in FIGS. 1 to 3, but shows a less diagrammatic view of the present invention. Furthermore the arrangement of air supply pipes in the third embodiment is more similar to that shown in FIG. 4. Where possible, when referring to FIGS. 6 to 8, like components will be give like reference numerals.

Referring to FIGS. 6, 7 and 8, there is shown an underwater breathing device generally indicated 69, comprising a bag 70 wherein a bladder 72 is located. A gas cylinder 21 is located in the lower part of the bag and is held in place by releasable straps 22. The cylinder 21 supplies pressurised air through an intermediate pressure hose 60 to a hose splitter 61 located near the top of the bag. A second stage regulator 32 (which is held in the mouth of a diver) is connected to the hose splitter by a breathing hose 65. Also connected to the hose splitter is a buoyancy hose 66 which extends to an inflator/deflator valve 76. This valve is operated to inflate and deflate, as already described above, the bladder 72 through a bladder supply hose 78.

FIG. 6 shows the contents of the bag 70 however in normal operation the bag is closed by a flap 79 as shown in FIG. 7. In use, the first stage regulator 32, the pressure gauge 35 and the inflator/deflator valve 76 extend out of the bag 70 so that they may be utilised by a diver. For convenience when handling the device, rather than wearing it, the bag is provided with side handles 80 and a top handle 82.

As best shown in FIG. 8, the front side of the bag 70 which in use is directed towards a diver's back is provided with various straps for attaching the present invention to a diver. Webbing straps 86 are attached to the surface of the bag 70. A pair of shoulder straps 88 and 90 are attached to the bag near the upper end thereof. The lower end of each shoulder strap is removably attachable to various anchor points located on the bag. In this Figure, the straps are shown attached to the lower anchor points 92, but higher anchor points 94 are also shown. These higher anchor points are useful if the present invention is to be worn by a small person or child.

For convenience, the inflator/deflator valve 76 as well as the buoyancy hose 66 and bladder supply hose 78 are removably held against the shoulder strap 90 by a tie strap 96. This ensures that the inflator/deflator valve 76 is located in front of a diver and is therefore convenient to operate.

A two-part waist strap 98 is attached to the bag 70 in a lower region thereof. The waist strap is adjustable in length and the two parts may be releasably interconnected by a snap fitting clip 100. The waist strap 98 is of a sufficient length to accommodate a large range of differently-sized divers. When the length of the waist strap is shortened for a small diver, a tail of an inconvenient length can result. This tail may be folded or pleated against the standing part of the strap and held in place by a Velcro® fastening band 102.

Drain holes 104 are provided at the bottom of the bag 70 so that liquid contained within the bag may conveniently drain as a diver leaves the water. In addition, a hose-tidy clip 106 is attached to the anchor point 92 so that spare air hoses such as 36 or 65 may be held in place whilst diving.

Whilst the present invention is presently primarily intended for use by small divers and for short "try-divers", and indeed the foregoing description concentrates mainly on these features, it will be appreciated that the use of such a device is not exclusively limited thereto. In order to minimise the weight of the present invention and allow it to be fitted to the diver's back within the carrier, it is important that a small cylinder is used. Such a small conventional cylinder is not capable of holding a large volume of gas so can support an adult diver for no more than a short period of time (around 15 minutes). However, the present invention would still fit to an adult and there are plenty of situations when such light and convenient to use diving apparatus, could be used. For example, those acquainted with recreational boating often have severe difficulties cause by debris fouling the propeller of a craft, whilst at sea. This debris must be cleared to allow the engine to run, but as a propeller is under water, doing this without the aid of breathing equipment is extremely difficult and dangerous. Unfortunately, conventional scuba equipment is too bulky and cumbersome either to be stored on a small boat for such an eventuality or to encourage a person to utilise it in such a situation. A simple, light and quick to use device according to the present invention could easily be stored in a small space on a boat and then utilised for such a short term task as clearing a fouled propeller.

The very fact that the present invention allows a single device to fit to almost any size of wearer means that the useability and convenience of the device is a significant enhancement over existing scuba equipment.

The present invention could find a number of other uses based on its standard functionality. For example, it could be used as a bail-out system for military assault teams. In addition, it could act as a marine rescue product like an advanced design of life preserver.

Whilst the supply of air in the cylinder is relatively small compared to a standard scuba gear, it can still be used to give a short supply of air. For example, it could be used as breathing apparatus for fireman both above and below water.

What is claimed is:

1. An underwater breathing device comprising a carrier in the form of a closable bag, said closable bag being made from a material that has elastic properties;

straps for securely attaching said carrier to the back of a diver;

a rigid baseboard that is located within said carrier and connected to the region thereof that in use is disposed adjacent the back of said diver;

a pressurized gas reservoir, said reservoir being connected horizontally to a lower part of said baseboard;

a buoyancy bladder, said buoyancy bladder being positioned above said gas reservoir within said carrier;

bladder control means operatively coupling said buoyancy bladder to said gas reservoir so that said buoyancy bladder may be inflated and deflated; and, a breathing regulator in communication with said gas reservoir to permit breathing of contained gas by said diver;

wherein the carrier wholly contains the buoyancy bladder the gas reservoir, and the rigid baseboard, and the bag can stretch and contract to accommodate changes in the volume of the buoyancy bladder in use.

2. An underwater breathing device as claimed in claim 1, wherein the gas reservoir and buoyancy bladder are independently removable to permit replacement.

3. An underwater breathing device as claimed in claim 1, wherein the bag is substantially formed from an elastic material.

4. An underwater breathing device as claimed in claim 1 in which elastic straps are provided in the material of the bag.

5. An underwater breathing device as claimed in claim 1, wherein the bag has a re-closable opening to permit access to the interior thereof.

6. An underwater breathing device as claimed in claim 1, wherein an elasticated restriction band is provided around the buoyancy bladder to aid its deflation.

7. An underwater breathing device as claimed in claim 1, wherein pouches to receive removable weights are provided on the carrier or baseboard.

8. An underwater breathing device as claimed in claim 7, wherein each shoulder strap has an upper and a lower end, and the lower end is releasably attachable to the external surface of the carrier at a plurality of locations.

9. An underwater breathing device as claimed in claim 1, wherein padding is provided on the part of the carrier disposed toward the diver's back.

10. An underwater breathing device as claimed in claim 1, wherein each strap passes in through a first entry aperture in the carrier and passes out through a second exit aperture; and the free ends may be passed around the diver to be connected together.

11. An underwater breathing device as claimed in claim 1, wherein each strap is attached to the external surface of the carrier.

12. An underwater breathing device as claimed in claim 1, wherein a waist strap and two shoulder straps are provided.

13. An underwater breathing device as claimed in claim 1, wherein the or each strap is adjustable in length.

14. An underwater breathing device as claimed in claim 1, wherein the regulator and the bladder control means pass out of the carrier.

15. An underwater breathing device as claimed in claim 1, wherein a gas reservoir pressure gauge is provided.

16. An underwater breathing device as claimed in claim 1, wherein external handles are provided on the carrier.

* * * * *